US009335658B2

(12) United States Patent
Uno

(10) Patent No.: US 9,335,658 B2
(45) Date of Patent: May 10, 2016

(54) DEVELOPER SUPPLY DEVICE WITH WALL BETWEEN CHAMBERS HAVING TWO HEIGHTS

(71) Applicant: BROTHER KOGYO KABUSHIKI KAISHA, Nagoya-shi, Aichi-ken (JP)

(72) Inventor: Takanori Uno, Nissin (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/941,443

(22) Filed: Jul. 12, 2013

(65) Prior Publication Data

US 2014/0016959 A1 Jan. 16, 2014

(30) Foreign Application Priority Data

Jul. 12, 2012 (JP) ..... 2012-156063

(51) Int. Cl.
*G03G 15/08* (2006.01)

(52) U.S. Cl.
CPC ..... *G03G 15/0839* (2013.01); *G03G 15/0805* (2013.01); *G03G 15/0815* (2013.01); *G03G 15/0865* (2013.01); *G03G 15/0877* (2013.01); *G03G 15/0891* (2013.01); *G03G 15/0898* (2013.01)

(58) Field of Classification Search
CPC ..... G03G 15/0839; G03G 15/0865; G03G 15/0891; G03G 15/0877; G03G 15/0898; G03G 15/1805; G03G 15/0815
USPC ..... 399/349, 351, 358, 103, 284, 287, 279, 399/281, 254, 255, 256, 291, 30
See application file for complete search history.

(56) References Cited

U.S. PATENT DOCUMENTS

| | | | | |
|---|---|---|---|---|
| 4,407,228 | A | 10/1983 | Takano et al. | |
| 5,293,181 | A | 3/1994 | Iwao et al. | |
| 5,510,882 | A * | 4/1996 | Kikuta et al. | 399/257 |
| 2002/0028095 | A1 * | 3/2002 | Miyasaka et al. | 399/281 |
| 2007/0025776 | A1 * | 2/2007 | Suzuki | 399/272 |
| 2008/0187332 | A1 * | 8/2008 | Tsuda et al. | 399/27 |
| 2011/0008073 | A1 * | 1/2011 | Kudo et al. | 399/254 |
| 2011/0129261 | A1 | 6/2011 | Sato | |
| 2011/0135344 | A1 * | 6/2011 | Ebe | 399/281 |
| 2011/0222913 | A1 * | 9/2011 | Sasaki et al. | 399/254 |
| 2012/0148314 | A1 * | 6/2012 | Park et al. | 399/281 |
| 2013/0011163 | A1 * | 1/2013 | Senda et al. | 399/254 |

FOREIGN PATENT DOCUMENTS

| | | |
|---|---|---|
| JP | S57-064266 A | 4/1982 |
| JP | S57-064759 A | 4/1982 |

(Continued)

*Primary Examiner* — Benjamin Schmitt
*Assistant Examiner* — Matthew Miller
(74) *Attorney, Agent, or Firm* — Merchant & Gould P.C.

(57) ABSTRACT

A developer supply device including a developer carrying body, extending in a width direction, configured to carry developer and a casing including an wall, extending in the width direction, disposed between a first room on which the developer carrying body is disposed and a second room configured to store the developer is provided. The first room and the second room communicate each other through an opening formed above the wall. The wall includes end portions having a first height and a central portion. The central portion is disposed between the end portions and has a second height which is higher than the first height.

18 Claims, 10 Drawing Sheets

(56) References Cited

FOREIGN PATENT DOCUMENTS

| | | | |
|---|---|---|---|
| JP | S57-100753 | U | 6/1982 |
| JP | S57-103449 | U | 6/1982 |
| JP | S57-108870 | A | 7/1982 |
| JP | S57-109965 | A | 7/1982 |
| JP | S58-057156 | A | 4/1983 |
| JP | 2007-304453 | A | 11/2007 |
| JP | 2010-276720 | A | 12/2010 |
| JP | 2011-113036 | A | 6/2011 |

* cited by examiner

DEVELOPER SUPPLY DEVICE WITH WALL BETWEEN CHAMBERS HAVING TWO HEIGHTS

CROSS-REFERENCE TO RELATED APPLICATION

This application claims priority under 35 U.S.C. §119 from Japanese Patent Applications No. 2012-156063 filed on Jul. 12, 2012. The entire subject matter of the application is incorporated herein by reference.

BACKGROUND

1. Technical Field

The following description relates to a developer supply device configured to supply dry-type developer (i.e., powdered developer) to an intended object.

2. Related Art

Various kinds of developer supply devices have been known. Specifically, a developer supply device including a so-called "brush roller" used as a developer carrying body a development roller) has been known.

SUMMARY

Aspects of the present invention are advantageous to provide a developer supply device which is capable of handling developer in a favorable manner (e.g., suppressing a leakage of the developer and carrying the developer appropriately).

According to aspects of the present invention, a developer supply device including a developer carrying body, extending in a width direction, configured to carry developer and a casing including an wall, extending in the width direction, disposed between a first room on which the developer carrying body is disposed and a second room configured to store the developer is provided. The first room and the second room communicate each other through an opening formed above the wall. The wall includes end portions having a first height and a central portion. The central portion is disposed between the end portions and has a second height which is higher than the first height.

BRIEF DESCRIPTION OF THE ACCOMPANYING DRAWINGS

DETAILED DESCRIPTION

Figure 1:
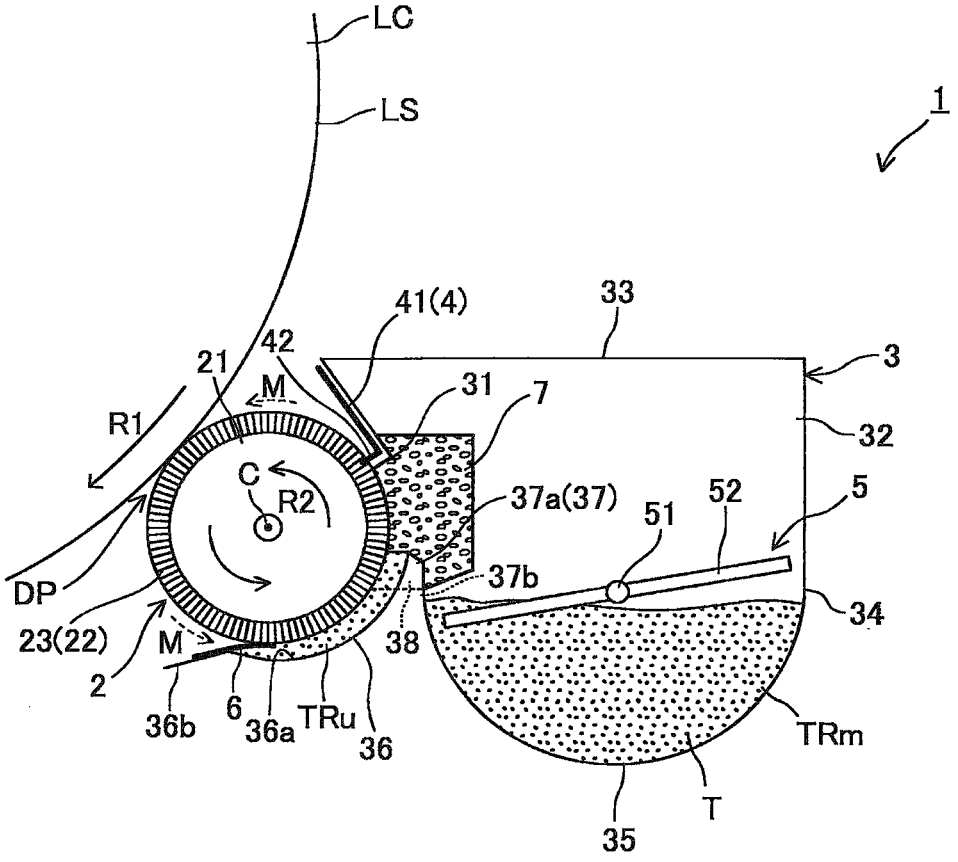
FIG. 1 is a cross-sectional side view schematically showing a configuration of a toner supply device in an embodiment according to one or more aspects of the present invention.
Figure 1:
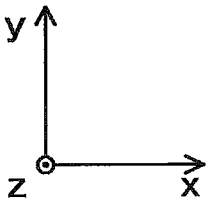

Hereinafter, an embodiment according to aspects of the invention will be described with reference to the accompany drawings. It is noted that modifications for the embodiment will be described at ending so as to avoid misunderstanding of the embodiment.

<Configuration>

Hereinafter, a configuration of a toner supply device 1 in the embodiment will be described with reference to FIGS. 1 and 2. It is noted that y-axis shown in drawings indicates a "vertical direction" that is parallel to a direction of gravitational force. Additionally, a positive direction of the y-axis indicates "upside" in the vertical direction.

A photoconductive drum LC, to which a developer is supplied in the embodiment, is a cylindrical member having a circumferential surface. The photoconductive drum LC is disposed rotatably about a central axis not shown) in a predetermined rotational direction R1 (i.e., a clockwise direction in FIG. 1). The central axis is parallel to z-axis shown in drawings, and the z-axis is parallel to a direction so-called "a main scanning direction" or "a sheet width direction." An electrostatic latent image carrying surface LS (hereinafter, referred to as an "image carrying surface LS"), on which an electrostatic latent image can be formed, is formed on the circumferential surface of the photoconductive drum LC. In the embodiment, length of the image carrying surface LS in the sheet width direction is equal to or longer than 210 mm so that maximum width of a recording sheet, on which an image can be recorded, is a width of "A4" size sheet of which a sheet width Dpp is 210 mm.

The toner supply device 1 is configured to supply toner T onto the image carrying surface LS formed on the circumferential surface of the photoconductive drum LC. The toner T is dry-type non-magnetic monocomponent developer (i.e., powdered non-magnetic monocomponent developer). The toner supply device 1 is configured to supply the toner T a development position DP of the image carrying surface LS so that an electrostatic latent image formed on the image carrying surface LS is developed, by the toner T. The toner supply device 1 includes a development roller 2, a casing 3, a restricting member 4, an agitator 5, a lower seal member 6 and side seal members 7.

The development roller 2 is a so-called "brush roller" which has a well-known configurations. Specifically, the development roller 2 includes a roller body 21 and a brush layer 22.

The roller body 21 is a cylindrical member having a circumferential surface. The brush layer 22 is formed on the circumferential surface of the roller body 21. The brush layer 22 has a plurality of fibrous members 23 attached on the circumferential surface of the roller body 21. The development roller 2 is configured to rotate about a development roller central axis C in a predetermined rotating direction R2 (i.e., a direction opposite to the rotational direction R1 and an anticlockwise direction in FIG. 1) with carrying the toner T on the brush layer 22. The development roller central axis C is parallel to the central axis of the photoconductive drum LC (not shown).

In the embodiment, the fibrous members 23 of the brush layer 22 are attached to the circumferential surface of the roller body 21 by electrostatic flocking. The fibrous members 23 are formed to be substantially straight when no external loading (i.e., loading applied by contacting the photoconductive drum LC) is applied to the fibrous members 23.

In the embodiment, the development roller 2 is disposed to face the photoconductive drum LC so that the brush layer 22 contact the image carrying surface LS at the development position DP. The "development position DP" is a position where the photoconductive drum LC and the development roller 2 face and contact each other. When the development roller 2 rotates in the rotational direction R2, the brush layer 22 moves to a direction orthogonal to the development roller central axis C (see "a movement direction M" indicated in an arrow in broken line in FIG. 1).

The casing 3 is a box member having an opening 31 extending along the development roller central axis C. The casing 3 is configured to store the toner T to be carried by the brush layer 22 in its inner space. In the embodiment, the opening 31 is formed on a lateral side of the casing 3. The casing 3 rotatably supports the development roller 2. The brush layer 22 is disposed at the opening 31 along the sheet width direction such that the brush layer 22 contacts the image carrying surface LS at the development position DP.

The casing 3 is made of rigid plastic (synthetic resin), such as polystyrene (i.e., the casing 3 is not made of elastic or sponge). The casing 3 includes a pair of side plates 32, a top plate 33, a rear plate 34, a main bottom plate 35 and a sub bottom plate 36. It is noted that, in the following description, only one reference number will be indicated for a plurality of components having the same reference numbers (e.g., the side plates 32, 32) for brevity.

The pair of side plates 32 are flat plate members disposed to be parallel with each other in a direction orthogonal to the development roller central axis C. In the embodiment, the development roller 2 is rotatably supported by the side plates 32 on the opening 31 side.

The top plate 33 is disposed to connect upper edges of the side plates 32 so as to cover a space between the side plates 32 from above. The rear plate 34 is disposed to connect rear edges of the side plates 32 and the top plate 33 so as to cover the space between the side plates 32 from a side opposite to a side on which the opening 31 is formed. The main bottom plate 35 and the sub bottom plate 36 integrally forms a bottom part of the casing 3.

The main bottom plate 35 substantially has a semicylinder shape or a horseshoe shape viewed from a direction parallel to the z-axis (i.e., the main bottom plate 35 is formed to open upward). The main bottom plate 35 is disposed at a side opposite to a side on which the opening 31 is formed. The main bottom plate 35 defines a main toner storage room TRm which is the largest room to store the toner T to be carried by the brush layer 22 in the inner space of the casing 3.

The sub bottom plate 36 is disposed below the development roller 2 and has a circular shape viewed from the direction parallel to the z-axis. The sub bottom plate 36 is formed to open obliquely upward so as to open toward the photoconductive drum LC. The sub bottom plate 36 is disposed to be adjacent to the main bottom plate 35 in a direction parallel to the x-axis. Specifically, the sub bottom plate 36 is closer to the opening 31 and disposed slightly higher than the main bottom plate 35.

Between an inner wall 36*a* of the sub bottom plate 36 facing the brush layer 22 and the brush layer 22, a clearance having a predetermined distance is formed. On a front end of the sub bottom plate 36 an upstream side end of the sub bottom plate 36 in the movement direction M), a lower seal fixing part 36*b* is formed. Additionally, a lower seal member 6 is fixed on the inner wall 36*a* side of the lower seal fixing part 36*b*.

The lower seal member 6 is an elongated sheet member extending along the development roller central axis C. Specifically, the lower seal member 6 is a plastic member such as polyester, and it may be referred to as a "lower film." The lower seal member 6 is disposed below the development roller 2 and contacts the brash layer 22 throughout the length of the brush layer 22 in the sheet width direction to prevent leakage of the toner T from the lower side of the opening 31 to outside. The lower seal member 6 is cantilevered on the lower seal fixing part 36*b* so as to extend along the movement direction M viewed from the direction parallel to the z-axis.

The sub bottom plate 36 defines a roller side toner storage room TRu for storing the toner T between the sub bottom plate 36 and the brush layer 22. Specifically, the roller side toner storage room TRu, which stores the toner T to be carried by the development roller 2, is defined by the lower side of the development roller 2, the lower seal member 6 and the inner wall 36*a* of the sub bottom plate 36.

In the embodiment, the roller side toner storage room TRu is disposed below the development roller 2 (i.e., below the development roller central axis C) along the brush layer 22. The roller side toner storage room TRu has length corresponding to the length of the brush layer 22 in the sheet width direction. In addition, the roller side toner storage room TRu is disposed obliquely upward of the main toner storage room TRm.

A dividing wall 37 is disposed between the main bottom plate 35 and the sub bottom plate 36. The dividing wall 37 is formed to project upward (i.e., toward an inner space of the casing 3) to divide the roller side toner storage room TRu and the main toner storage room TRm. In the embodiment, the dividing wall 37 extends from one of the side plates 32 to the other of the side plates 32 along the sheet width direction.

Additionally, in the embodiment, the dividing wall 37 includes a higher projecting part 37*a* and at least one lower projecting part 37*b*. The higher projecting part 37*a* is disposed on a center part of the dividing wall 37 in the sheet width direction. The height of the lower projecting part 37*b* in the vertical direction is lower than that of the higher projecting part 37*a*. The lower projecting part 37*b* is disposed at least one of end portions of the dividing wall 37 in the sheet width direction. In the embodiment, two lower projecting parts 37*b* are disposed at both end portions of the dividing wall 37 in the sheet width direction. The cutout portions formed on both end portions of the dividing wall 37 in the sheet width direction (i.e., portions corresponding to the lower projecting parts 37*b*) define toner passages 38.

The toner T can be conveyed between the roller side toner storage room TRu and the main toner storage room TRm over an upper edge of the higher projecting part 37*a*. Additionally, the toner T can flow between the roller side toner storage room TRu and the main toner storage room TRm through the toner passages 38 (i.e., downward of the upper edge of the higher projecting part 37*a*). The upper edges of the lower projecting parts 37*b* are formed to be stepped, with respect to the upper edge of the higher projecting part 37*a*, in a direction opposite to a direction that the higher projecting part 37*a* is projected.

The restricting member 4 restricts an amount of the tonner T carried by the brush layer 22 by removing a part of the toner T temporarily carried by the brush layer 22. The restricting member 4 is disposed to face the development roller 2 so as to contact the brush layer 22 at an upstream side in the movement direction M of the brush layer 22 of the development roller 2. The restricting member 4 includes a blade part 41 and a restricting part 42.

The blade part 41 is a plate-dike member fixed at the opening 31 side edge of the top plate 33 of the casing 3. The blade part 41 is disposed to extend from the downstream side to the upstream side of the movement direction M. The restricting part 42 is disposed on a leading edge of the blade part 41 in a direction that the blade part 41 extends. The restricting part 42 extends from the leading edge of the blade part 41 to the development roller central axis C no as to penetrate into the brush layer 22.

Specifically, the restricting member 4 is integrally formed by bending a thin metal plate, such as stainless steel. The restricting member 4 is disposed so that the restricting part 42 contacts the brush layer 22 above the roller side toner storage room TRu and at a downstream side of the roller side toner storage room TRu in the movement direction M. The restricting member 4 extends from the downstream side to the upstream side of the rotational direction R2 of the development roller 2 (i.e., extends to a direction opposite to the movement direction M) so as to direct the removed toner T to the main toner storage room TRm.

The agitator 5 is accommodated in the main toner storage room TRm to agitate the toner T stored in the main toner storage room TRm. The agitator 5 conveys the toner T from the main toner storage room TRm to the roller side toner storage room TRu over the dividing wall 37 (mostly, over the higher projecting part 37*a*). The agitator 5 includes an agitator central shaft 51 and rotating members 52.

The agitator central shaft 51 is a round bar member disposed parallel to the development roller central axis C. The agitator central shaft 51 is rotatably supported by the pair of the side plates 32.

The rotating members 52 are disposed in the main toner storage room TRm The rotating members 52 are fixed to the agitator central shaft 51 so that the rotating members 52 move in the main toner storage room TRm (i.e., rotates about the agitator central shaft 51) as the agitator central shaft 51 rotating in a predetermined direction (i.e., a clockwise direction in FIG. 1). In the embodiment, two rotating members 52 are symmetrically fixed to the agitator central shaft 51.

Figure 2:
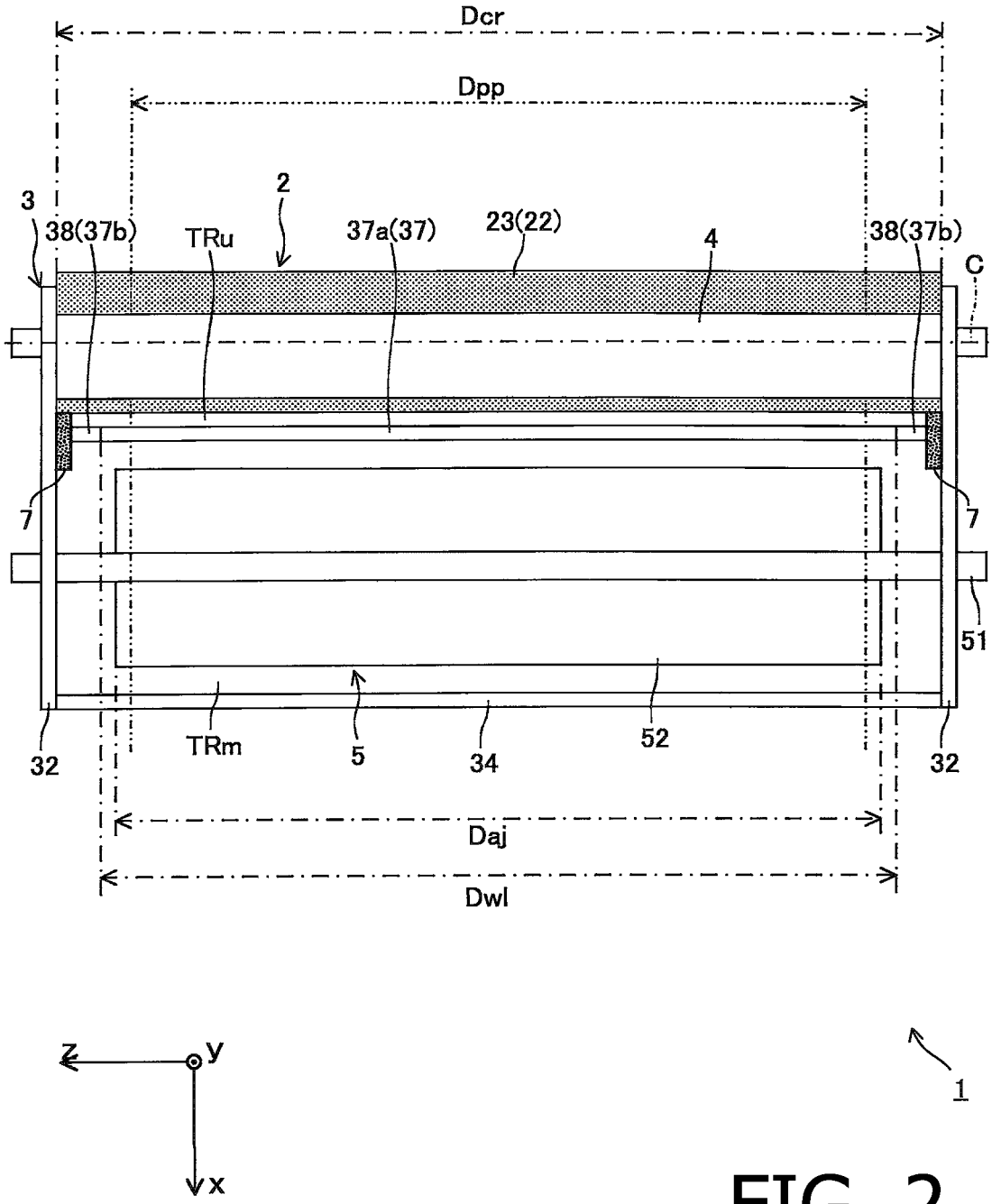
FIG. 2 is a plane view showing the toner supply device shown in FIG. 1.

In the embodiment, the toner supply device 1 is configured to satisfy a following relationship as shown in FIG. 2, when Dcr is length of the brush layer 22 in the sheet width direction, Dwl is length of the higher projecting part 37*a* of the dividing wall 37 in the sheet width direction (i.e., length of a portion of the dividing wall 37 on which the toner passages 38 are not formed), and Daj is length of the rotating member 52 in the sheet width direction.

$$Dcr>Dwl>Daj\geq Dpp$$

The pair of side seal members 7 are disposed at both ends of the opening 31 in the sheet width direction to prevent leakage of the toner T from the opening 31. Specifically, in the embodiment, the side seal members 7 are disposed to contact the both ends of the circumferential surface of the brush layer 22 in the sheet width direction. The side seal members 7 are fixed on the inner wall of the side plates 32 of the casing 3 with a double sided tape, and the like.

In the toner supply device 1 of the above embodiment, the agitator 5 is driven to rotate in the predetermined direction (e.g., a clockwise direction in FIG. 1) and the toner T is lifted (thrown up) by the rotating members 52 moving upwards. Then, the toner T is conveyed from the main toner storage room TRm to the roller side toner storage TRu over the dividing wall 37 (mostly, the higher projecting part 37*a*).

The toner T stored in the roller side toner storage room TRu is supplied to the circumferential surface of the development roller 2 (i.e., the brush layer 22 in the embodiment, the same shall apply hereinafter) which moves in the movement direction M with a rotation of the development roller 2. The circumferential surface of the development roller 2 carries the toner T at a position facing the roller side toner storage room TRu. The circumferential surface of the development roller 2 contacts the restricting member 4 when it further moves in the movement direction M with the rotation of the development roller 2. Then, the amount of the toner T carried by the circumferential surface of the development roller 2 (i.e., the brush layer 22) is restricted (adjusted) by the restricting member 4.

After the amount of the toner T is restricted by the restricting member 4, the circumferential surface of the development roller 2 carrying the toner T further moves in the movement direction M with the rotation of the development roller 2 and reaches the development position DP. At the development position DP, the toner T carried by the circumferential surface of the development roller 2 is supplied to the image carrying surface LS. After the toner T is supplied to the image carrying surface LS, the circumferential surface of the development roller 2 moves in the movement direction M with the rotation of the development roller 2 and reaches a position facing the roller side toner storage room TRu again.

As described above, during the rotation of the development roller 2, the leakage of the toner T from the downward of the opening 31 of the casing 3 is prevented by the lower seal member 6 which contacts the circumferential surface of the development roller 2. Additionally, the leakage of the toner T from the ends of the opening 31 in the sheet width direction is prevented by the side seal members 7 which contact the circumferential surface of the development roller 2.

Here, it is assumed a case where the amount of the toner T in the roller side toner storage room TRu becomes excessive for some reasons (it is noted that such a case would be suppressed immediately in the embodiment, as described later). For example, such a case might happen when an area of an image to be formed on the image carrying surface LS is small and such a situation is continued for a relatively long period.

In such a case, the toner T might leak from the opening 31 (especially, from a clearance between the side seal member 7 and the development roller 2) to outside. Additionally, since the "brush roller" is used as the development roller 2 in the embodiment, the toner T could be pressed into the brush layer 22 and a large amount of the toner T could be jammed inside the fibrous members 23. This might cause a defect so-called "fog" in a white background. The fog in the white background becomes outstanding as the number of the operations (i.e., the number of image forming operation) increases.

In contrast, according to the toner supply device 1 in the embodiment, the toner passages 38 are formed at both end portions of the dividing wall 37 in the sheet width direction. Therefore, the tanner T may flow from the roller side toner storage room TRu to the main toner storage room TRm through the toner passages 38 when the amount of the tanner T in the roller side toner storage room TRu becomes mass.

Additionally, the toner supply device 1 in the embodiment satisfies the relationship "Dcr>Dwl≥Daj." That is, the rotating members 52 of the agitator 5 do not face the toner passages 38 in the embodiment. Therefore, the toner T is conveyed from the main toner storage room TRm to the roller side toner storage room TRu by the agitator 5 mostly over the higher projecting part 37*a*, and the toner T may return from the roller side toner storage room TRu to the main toner storage room TRm through the toner passages 38.

Thus, according to the toner supply device 1 of the embodiment, the amount of the toner T in the roller side toner storage room TRu may be adjusted by the contribution of the toner passage 38. Therefore, the case where the amount of the tanner T in the roller side toner storage room TRu becomes excessive can be prevented. Further, durability of the toner T can be improved since the toner T may circulate between the roller side toner storage room TRu and the main toner storage room TRm favorably.

As described above, according to the toner supply device 1 of the embodiment, the toner T can be handled in a favorable manner, and the leakage of the toner T from the opening 31 to the outside can be prevented. As a result, an image forming (i.e., development of the electrostatic latent image) can be performed appropriately.

<Examples of Modifications>

Hereinabove, the embodiment according to aspects of the present invention has been described. The present invention can be practiced by employing conventional materials, methodology and equipment. Accordingly; the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and a few examples of their versatility are shown and described in the present disclosure. It is to be understood that the present invention is capable of use in various other combinations and environments and is capable of changes or modifications within the scope of the inventive concept as expressed herein. For example, the following modifications are possible. In the following modifications, the same reference numbers are put to components having the same functions as the above described embodiment.

The intended object to which the developer is supplied, is not limited to the photoconductive drum. Aspects of the present invention may apply to a photoconductive body formed in a shape of a plate or an endless belt. Furthermore, aspects of the present invention may be applied to image forming apparatuses employing methods (such as a toner-jet method, an ion flow method, and a multi-stylus electrode method using no photoconductive body) other than the aforementioned electrophotographic method. In this case, image forming media such as papers, aperture electrodes or the like would be the intended object.

The restricting member 4 can be made of a materials other than the metal. For example, the restricting member 4 may be made of plastic. In this case, an electrically-conductive plastic may be used for the restricting member 4 to suppress electrostatic charge.

Additionally, only one toner passage 38 may be disposed at one of the end portions of the dividing wall 37 in the sheet width direction. Further, the toner passage 38 may be formed as a penetrating hole. That is, an upper edge of the toner passage 38 (an edge of the dividing wall 37 in the projecting direction) may be covered.

Figure 3:
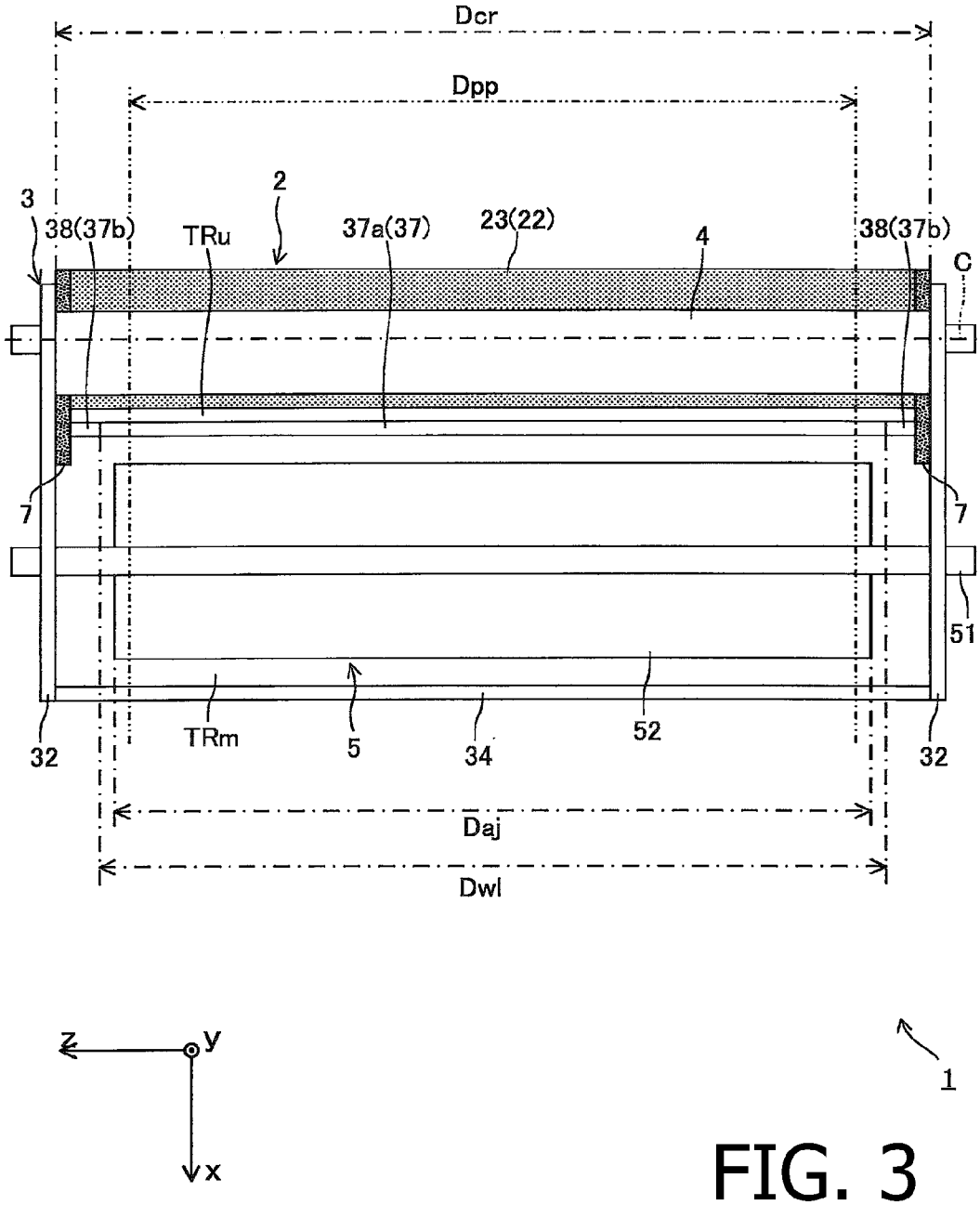
FIG. 3 is a plane view showing a first modification of the toner supply device shown in FIG. 2.

As shown in FIG. 3, the side seal members 7 may be disposed to contact edge faces (i.e., a surface orthogonal to the development roller central axis C) of the development roller 2 (the brush layer 22) from outside in the sheet width direction. That is, the each side seal member 7 may be held between the edge face of the development roller 2 the brush layer 22) and the side plate 32 of the casing 3.

In the above embodiment, the rotating members 52 of the agitator 5 are disposed not to face the toner passages 38 (i.e., Dcr>Dwl≥Daj) so that the toner T flows from the roller side toner storage room TRu to the main toner storage room TRm through the toner passages 38. However, the invention may not be limited to such a configuration.

Figure 4:
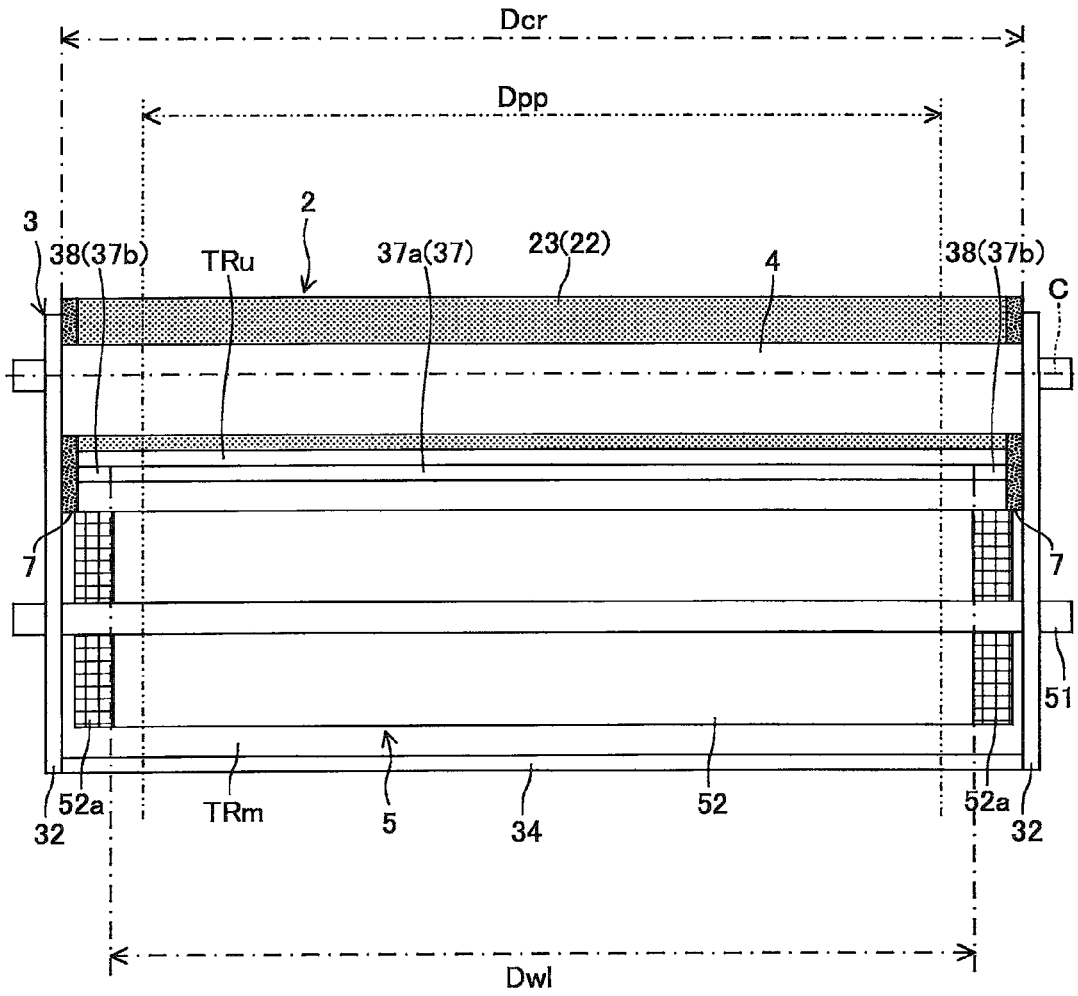
FIG. 4 is a plane view showing a second modification of the toner supply device shown in FIG. 2.
Figure 4:
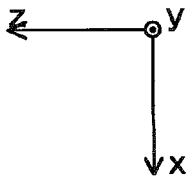
Figure 4:
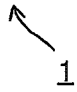

For example, the agitator 5 (the rotating member 52) may be formed so that force to convey the toner T from the main toner storage room TRm to the roller side toner storage room TRu is weaker by a portion (position) of the rotating member 52 facing the toner passage 38 than by the other portion (position) of the rotating member 52 (i.e., a portion which does not face the toner passage 38). Specifically, the rotating member 52 may have a different shape in a portion facing the toner passage 38. FIGS. 4 though 6 show modifications of the rotating member 52.

Figure 5:
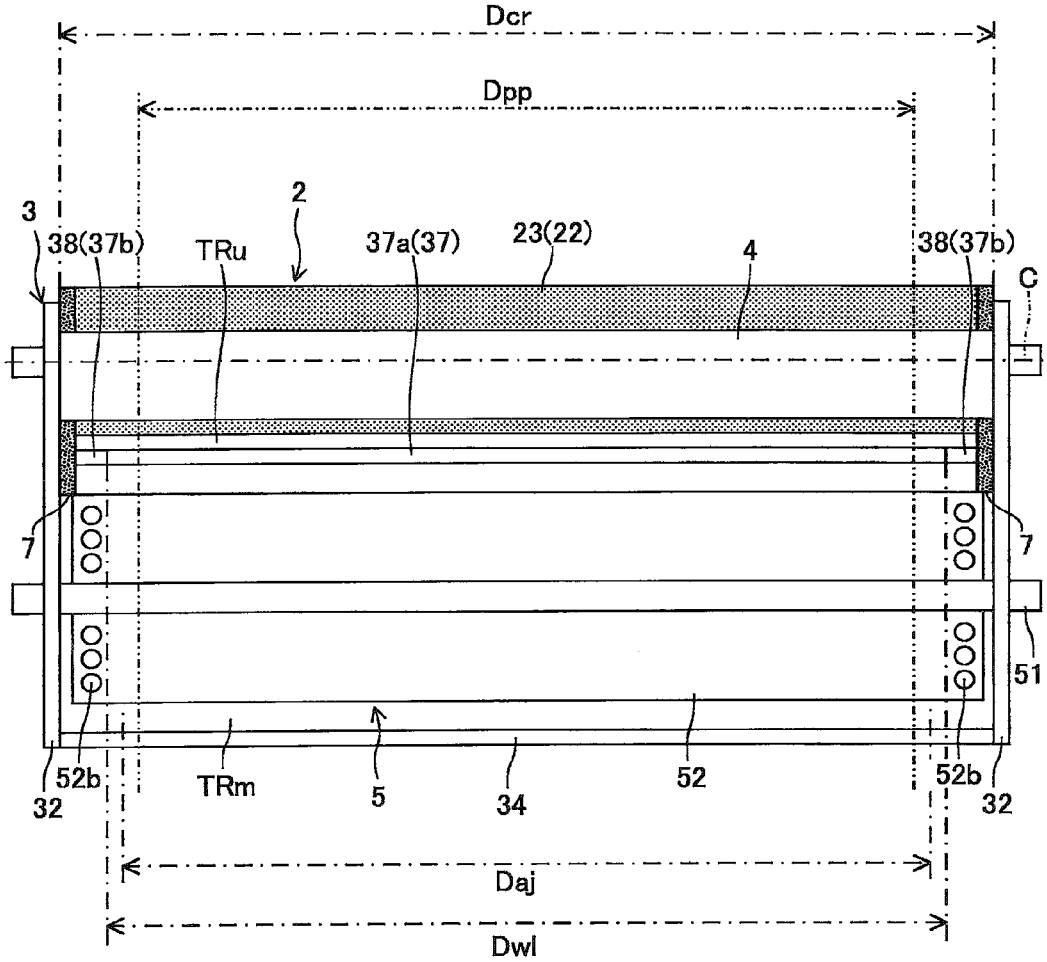
FIG. 5 is a plane view showing a third modification of the toner supply device shown in FIG. 2.
Figure 5:
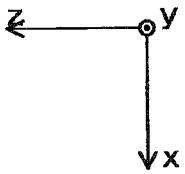
Figure 5:
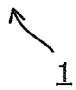

As shown in FIG. 4, the rotating members 52 may have mesh portions 52*a* having a plurality of small holes in positions facing the toner passages 38. Alternatively, the rotating members 52 may have a plurality of penetrating holes 52*b* in positions facing the toner passages 38 as shown in FIG. 5. In this regard, one or more penetrating holes 52*b* may be formed on the rotating members 52. Additionally, the plurality of penetrating holes can be arranged arbitrarily.

Figure 6:
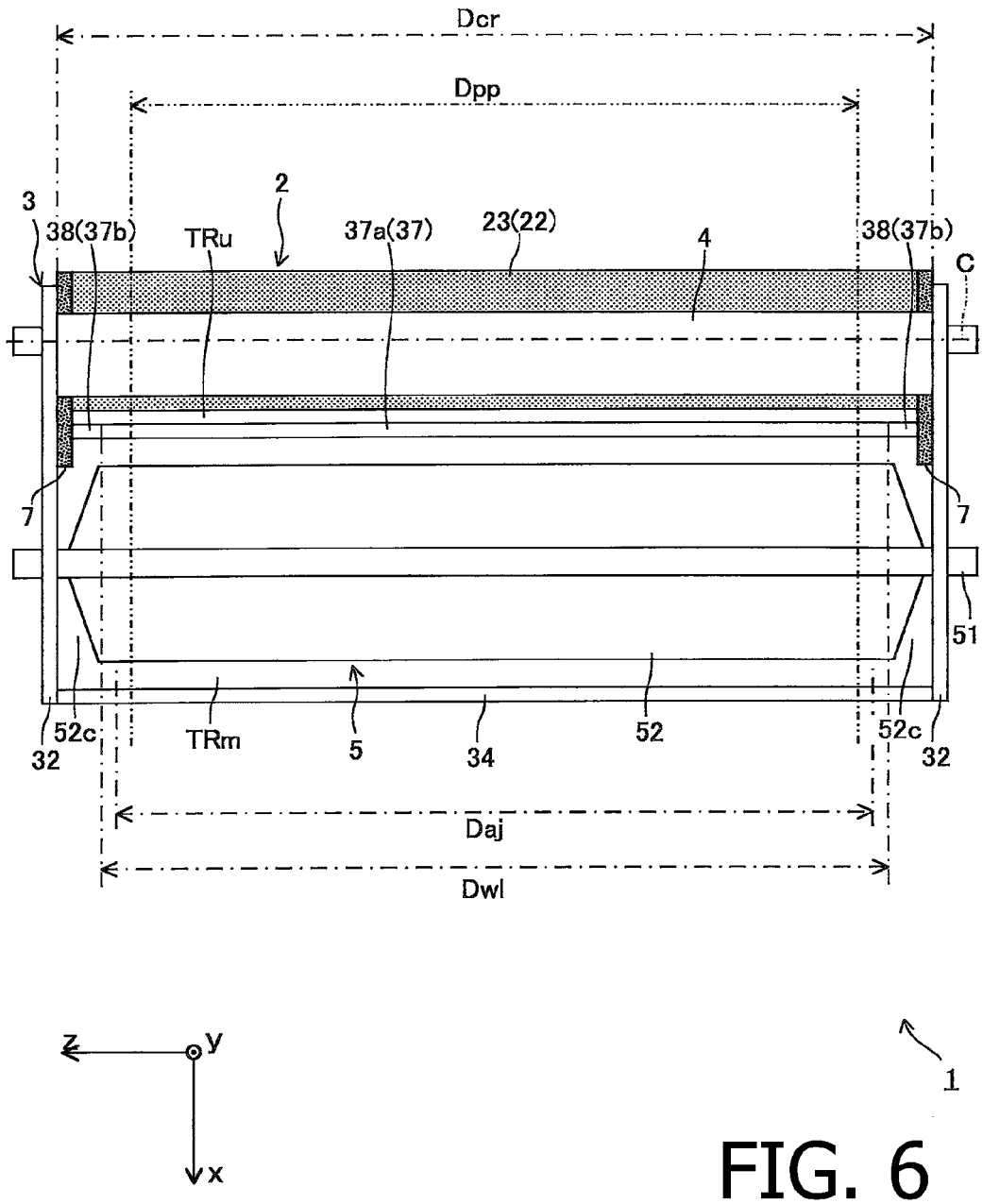
FIG. 6 is a plane view showing a fourth modification of the toner supply device shown in FIG. 2.

Alternatively, the rotating members 52 may have cutout parts 52*c* (i.e., a part where the rotating member 52 is cut out) in positions facing the toner passages 38 as shown in FIG. 6. In this case, the cutout part 52*c* may have a triangular shape as shown in FIG. 6 or a rectangular shape (i.e., a shape like a stair case).

In the modifications shown in FIGS. 4 through 6, the toner T is mostly conveyed from the main toner storage room TRm to the roller side toner storage room TRu by the center portion of the rotating members 52 on which the mesh parts 52*a* and the like are not formed (i.e. a part of which force to convey the tonner T is strong). According to this configuration, the toner T is mostly conveyed from the main toner storage room TRm to the roller side toner storage room TRu over the portion other than the toner passage 38 of the dividing wall 37 (i.e., the higher projecting part 37*a*).

On the other hand, the mesh parts 52*a* and the like are formed on the portions facing the toner passages 38 of the rotating members 52. Thus, the force to convey the toner T from the roller side toner storage room TRu to the main toner storage room TRm over the toner passages 38 is weak. Therefore, the toner T may flow from the roller side toner storage room TRu to the main toner storage room TRm. According to this configuration, the toner T can be handled in a favorable manner similarly to the above embodiment even if the width of the rotating members 52 of the agitator 5 is wider than the width of the portion of the dividing wall 37 on which the toner passages 38 are not formed (i.e., the higher projecting part 37*a*).

Additionally, the configurations of the casing 3 and the agitator 5 may not limited to the above embodiment and modifications.

Figure 7:
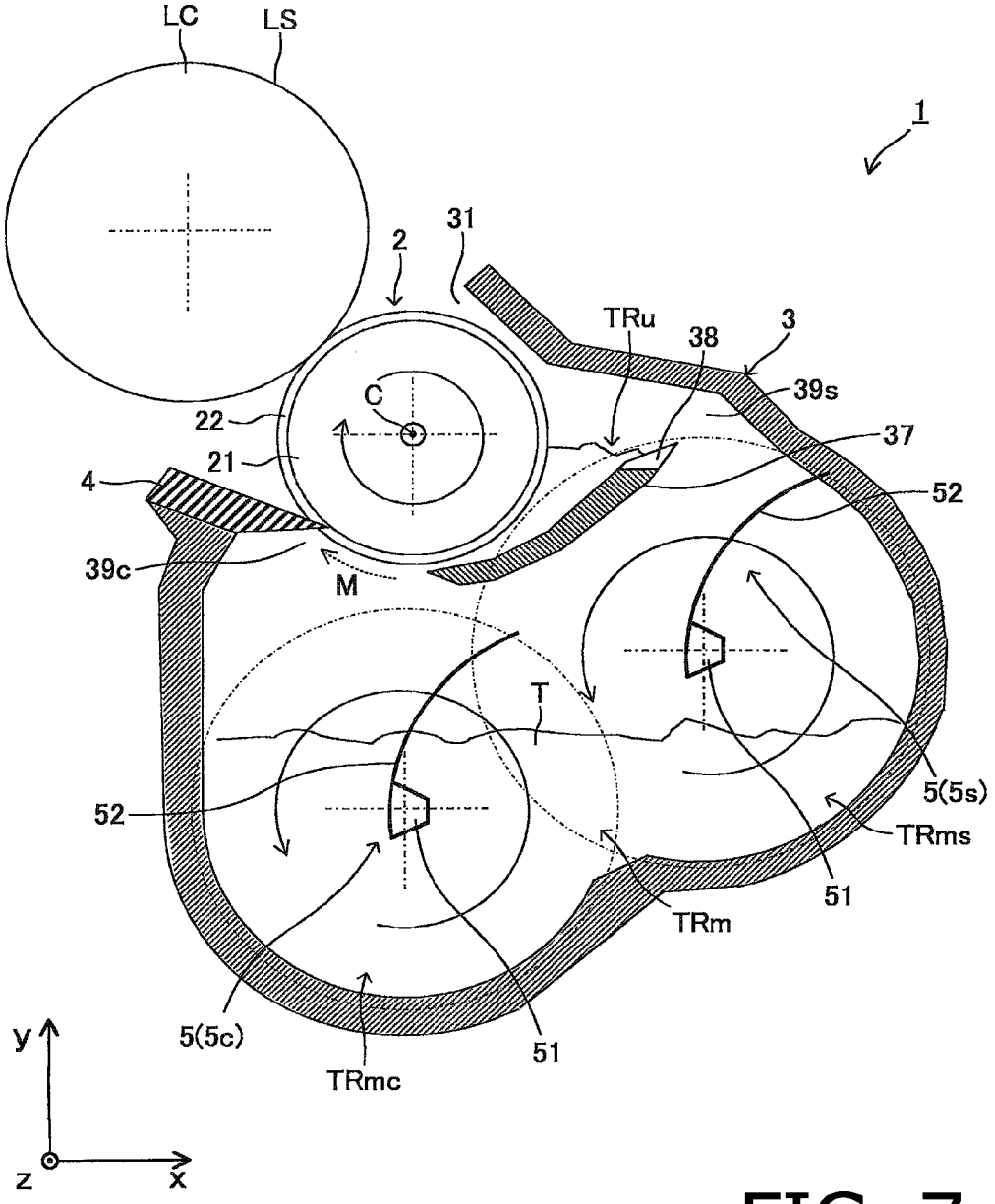
FIG. 7 is a cross-sectional side view schematically showing a configuration of a fifth modification of the toner supply device shown in FIG. 1.

For example, a plurality of the agitators 5 may be accommodated in the main toner storage room TRm as shown in FIG. 7. The shape of the agitator central shaft 51 may not limited to the round bar. Further, the rotating members 52 may be fixed to the agitator central shaft 51 asymmetry. For example, one edge of the one rotating member 52 may be fixed to the agitator central shaft 51.

As shown in FIG. 7, the opening 31 may be formed to open substantially upward (upward or obliquely upward). In this case, the roller side toner storage room TRu is disposed above (almost directly above) the main toner storage room TRm.

Hereinafter, detailed configuration of a modification of the toner supply device 1 shown in FIG. 7 will be described. In the modification, a collecting side main toner storage room TRmc and a supplying side main toner storage room TRms are disposed below the roller side toner storage room TRu in the casing 3. The collecting side main toner storage room TRmc and the supplying side main toner storage room TRms are adjacent to each other. It is noted that a rotational direction of the development roller 2 in the modification is opposite to the rotational direction R2 in the above embodiment (i.e., a clockwise direction in FIG. 7).

The collecting side main toner storage room TRmc is disposed at the lowest part of the casing 3 and substantially directly below the roller side toner storage room TRu. The supplying side main toner storage room TRms is disposed obliquely above the collecting side main toner storage room TRmc and obliquely below the roller side toner storage room TRu.

In the modification, the roller side toner storage room TRu is disposed to be adjacent to and obliquely below the development roller 2. Inside the casing 3, the dividing wall 37 which divides the supplying side main toner storage room TRms and the roller side toner storage room TRu is disposed. The roller side toner storage room TRu is formed between the development roller 2 and the dividing wall 37 for storing the toner T. The roller side toner storage room TRu is disposed between the development roller 2 and the supplying side main toner storage room TRms.

A toner supplying passage 39*s* is formed between the supplying side main toner storage room TRms side edge of the dividing wall 37 and the inner wall of the casing 3. Additionally, a toner collecting passage 39*c* is formed between the roller side toner storage room TRu side edge of the dividing wall 37 and the inner wall of the casing 3. The toner collecting passage 39*c* is disposed downstream side of the toner supplying passage 39*s* in the movement direction M of the brush layer 22 of the development roller 2.

In the modification, the toner supplying passage 39*s* is formed to allow the supplying side main toner storage room TRms to communicate with the roller side toner storage room TRu. Further, similarly to the above embodiment, at least one toner passage 38 is formed on the supplying side main toner storage room TRms side end portion of the dividing wall 37. In the modification, two toner passages 38 are formed on both end portions of the dividing wall 37 in the sheet width direction.

In the modification, a clearance between the dividing wall 37 and the circumferential surface of the development roller 2 (the brush layer 22) is defined as described below, in order to store a predetermined amount of the toner T in the roller side toner storage room TRu. The clearance in the toner collecting passage 39*c* side end is narrow so that the toner T hardly passes therethrough. On the other hand, the clearance in the toner supplying passage 39*s* side end is broader than that of the toner collecting passage 39*c* side end. That is, the clearance is widened from the toner collecting passage 39*c* side end toward the toner supplying passage 39*s* side end.

A collecting side agitator 5*c* is accommodated in the collecting side main toner storage room TRmc, and a supplying side agitator 5*s* is accommodated in the supplying side main toner storage room TRms. The collecting side agitator 5*c* conveys the toner T stored in the collecting side main toner storage room TRmc to the supplying side main toner storage room TRms with agitating the same. The supplying side agitator 5*s* conveys the toner T stored in the supplying side main toner storage room TRms to the roller side toner storage room TRu with agitating the same.

According to the configuration in the modification, the circumferential surface of the development roller 2. (the brush layer 22) is immersed in the toner T stored in the roller side toner storage room TRu so that the toner T is temporarily carried by the brush layer 22. Then, a part of the toner T carried by the brush layer 22 is removed by the restricting member 4 and accumulated in the underlying collecting side main toner storage room TRmc through the toner collecting passage 39*c*.

The toner T stored in the collecting side main toner storage room TRmc is conveyed to the supplying side main toner storage room TRms while it is favorably fluidized by the agitation with the collecting side agitator 5*c*. The toner T stored in the supplying side main toner storage room TRms is conveyed to the roller side toner storage room TRu while it is favorably fluidized by the agitation with the supplying side agitator 5*s*.

According to the configuration of the modification, the toner T may flow from the roller side toner storage room TRu to the supplying side main toner storage room TRms through the toner passages 38 formed on the end portions of the dividing wall 37 in the sheet width direction. Thus, an amount of the toner T in the roller side toner storage room TRu is adjusted favorably by the contribution of the toner passage 38.

Figure 8:
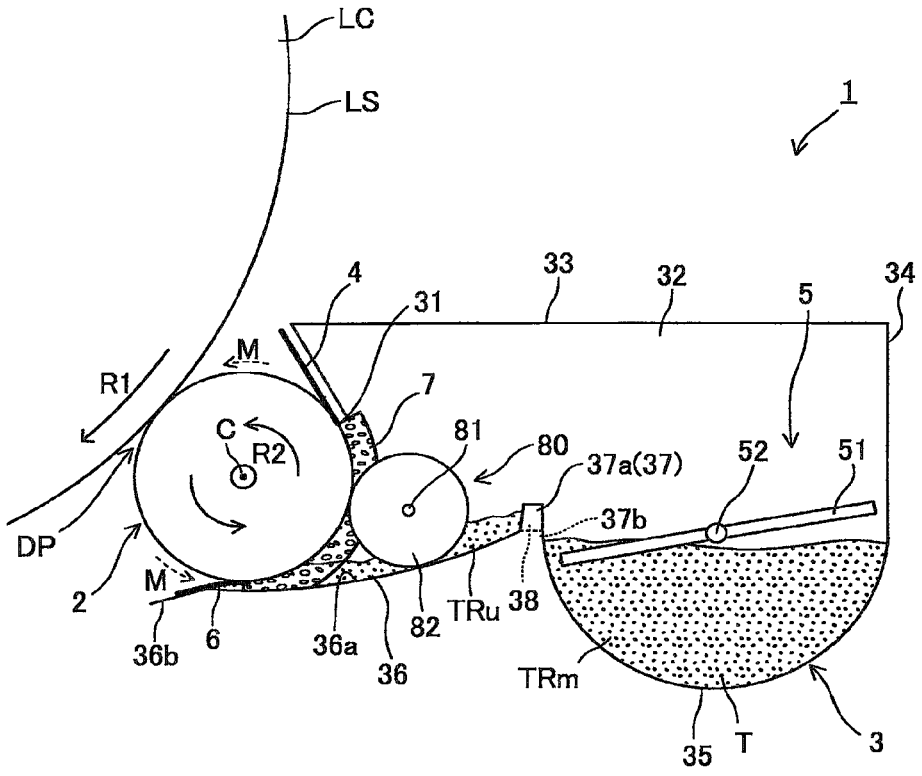
FIG. 8 is a cross-sectional side view schematically showing a configuration of a sixth modification of the toner supply device shown in FIG. 1.
Figure 8:
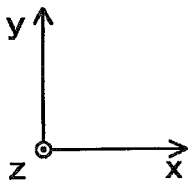
Figure 9:
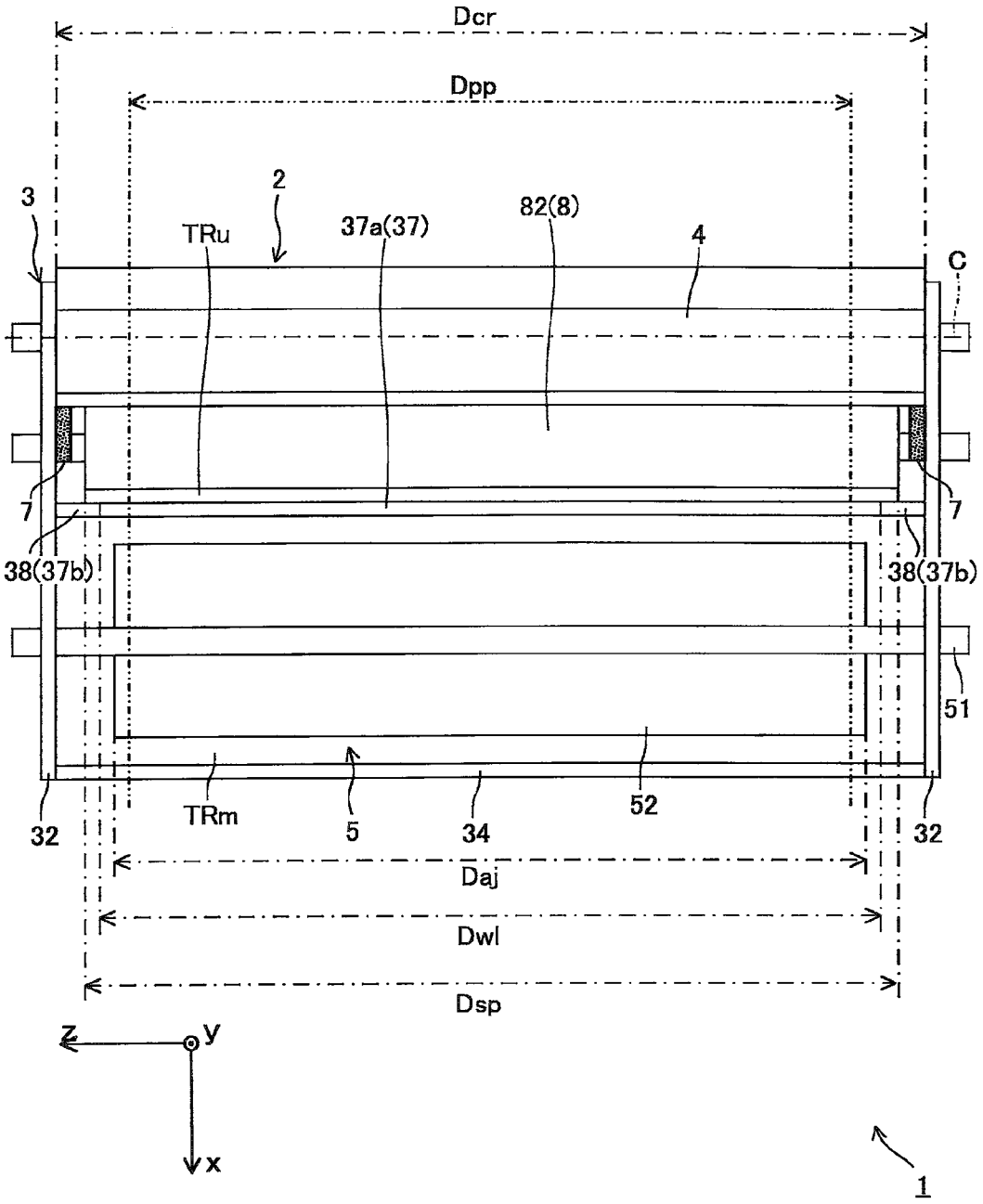
FIG. 9 is a plane view showing the toner supply device shown in FIG. 8.
Figure 10:
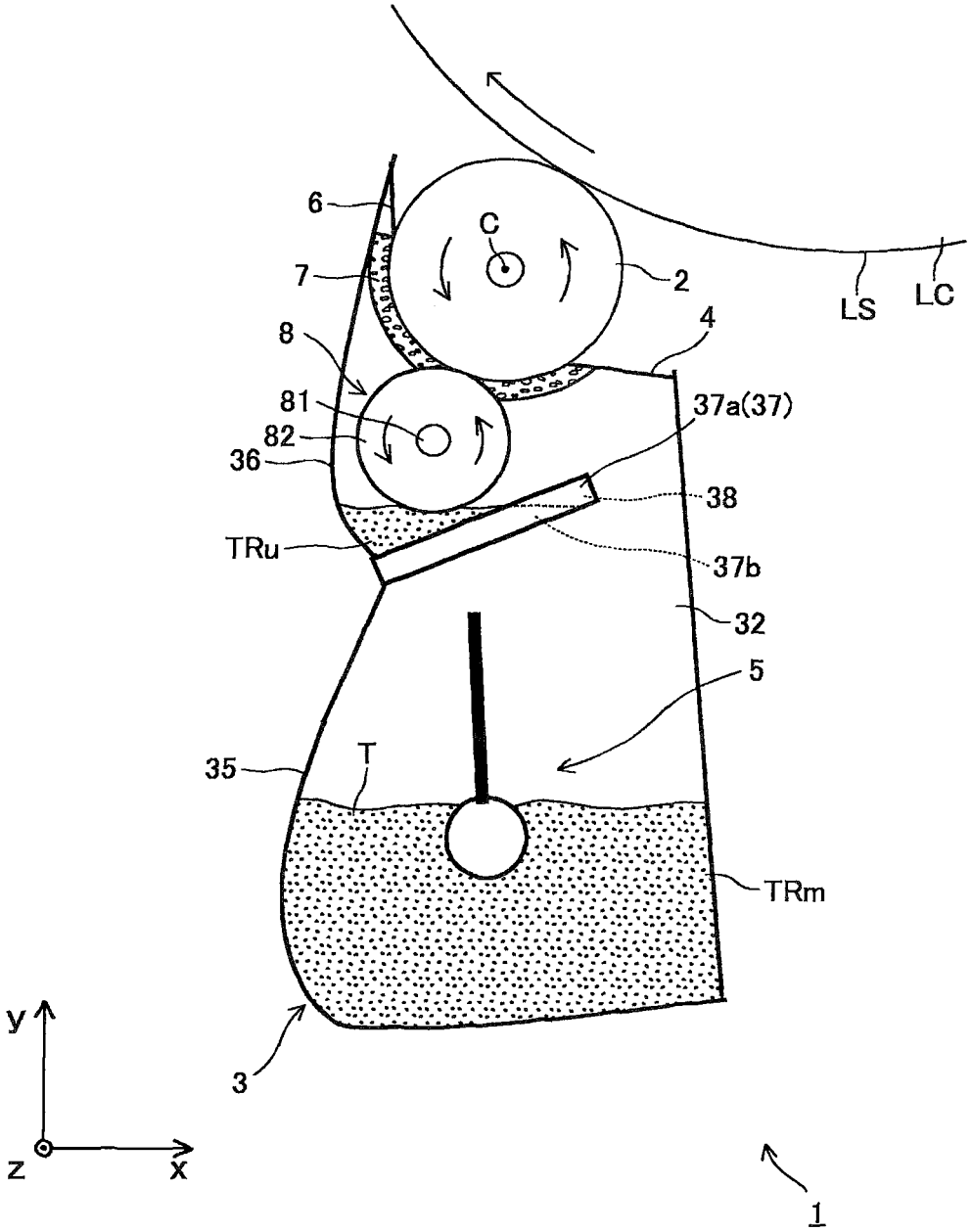
FIG. 10 is a cross-sectional side view schematically showing a configuration of a seventh modification of the toner supply device shown in FIG. 8.

Additionally, the invention is not limited to the configuration in which a so-called "brush roller" is used as the development roller 2. For example, the circumferential surface of the development roller 2 may be formed as elastic layer, plastic layer, or metallic layer instead of the brush layer 22 (hereinafter, referred to as a "solid roller"). FIGS. 8 through 10 show modifications which use the solid roller as the development roller 2.

As shown in FIG. 8, a supplying roller 80 is disposed in the casing 3 when the "solid roller" is used as the development roller 2. The supplying roller 80 is disposed to face the roller side toner storage room TRu so that a part of the supplying roller 80 is immersed in the toner T stored in the roller side toner storage room TRu. The supplying roller 80 supplies the toner T to the circumferential surface of the development roller 2. The supplying roller 80 may be a sponge roller or a brush roller. The supplying roller 80 is a rotating member disposed parallel to the development roller central axis C between the development roller 2 and the dividing wall 37. The supplying roller 80 is driven to rotate for supplying the toner T in the roller side toner storage room TRu to the circumferential surface of the development roller 2.

Specifically, the supplying roller 80 includes around bar shaped supplying roller shaft 8 and a toner supplying layer 82 formed around the supplying roller shaft 81. The toner supplying layer 82 may be formed by sponge or brush. The supplying roller 80 is disposed so that the toner supplying layer 82 contacts the circumferential surface of the development roller 2.

In the configuration of the modification, the toner passages 38 are formed on the end portions of the dividing wall 37 in the sheet width direction. The toner passages 38 allow the toner T to flow from the roller side toner storage room TRu to the supplying side main toner storage room TRms, similarly to the above embodiment. Thus, an amount of the toner T in the roller side toner storage room TRu is adjusted by having the contribution of the toner passage 38. Additionally, the case where the amount of the tonner T in the roller side toner storage room TRu becomes excessive can be prevented. Further, the toner T may circulate between the roller side toner storage room TRu and the main toner storage room TRm favorably.

Incidentally, the toner supply device 1 in the modification may be configured to satisfy the following relationship as shown in FIG. 9, when Dsp is length of the supplying roller 80 (i.e., the toner supplying layer 82) in the sheet width direction.

$$Dcr \geq Dsp > Dwl \geq Daj$$

Alternatively, the agitator 5 (the rotating members 52) of the toner supply device 1 in the modification may be formed so that force to convey the toner T from the main toner storage room TRm to the roller side toner storage room TRu is weaker by a portion of the rotating member 52 facing the toner passage 38 than by the other portion of the rotating member 52 (i.e., a portion which does not face the toner passage 38) as shown in FIGS. 4 through 6. According to this configuration, the toner T can be handled in a favorable manner similarly to the above embodiment even if the width of the rotating member 52 of the agitator 5 is wider than the width of the portion of the dividing wall 37 on which the toner passages 38 are not formed (i.e., the higher projecting part 37*a*).

Additionally, the roller side toner storage room TRu and the main toner storage room TRm may be disposed to be adjacent each other along a direction parallel to the x-axis as shown in FIG. 8 or along a direction parallel to the y-axis as shown in FIG. 10.

Further, the supplying roller 80 may be used in the toner supply device 1 which uses the "brush roller" as the development roller 2. In other words, the brush roller shown in FIG. 1 may be used as the development roller 2 shown in FIGS. 8 and 10.

What is claimed is:

1. A developer supply device, comprising:

a roller configured to carry developer, extending in a first direction the first direction being in a direction of a rotation axis of the roller and horizontal when the developer supply device is in use;

a casing in which a first room and a second room are defined, the roller being disposed in the first room, the second room being configured to store the developer;

a wall extending over a length of the casing in the first direction, the first room and the second room being partitioned by the wall, an opening being formed above the wall over the length of the wall when the developer supply device is in use; and an agitator configured to convey the developer from the second room to the first room, the agitator including a shaft and a rotating member fixed to the shaft, the shaft being rotatably supported by the casing and configured to rotate in the second room;

wherein the wall is divided into:

end portions which are both end portions, in the first direction, of the wall and having a first height at upper ends of the end portions; and a central portion defined as a portion, between the end portions, having a predetermined length in the first direction and having a second height which is higher than the first height, the central portion having an upper end that is continuous with the upper ends of the end portions, wherein the agitator is configured to convey the developer from the second room to the first room through at least a portion of the opening which is formed above at least the central portion of the wall, wherein the developer conveyed over the wall accumulates in the first room, wherein the roller is configured to collect the developer accumulated in the first room, and wherein the rotating member of the agitator includes a central conveyance portion corresponding to the central portions of the wall and end conveyance portions respectively corresponding to the end portions of the wall, each of the end conveyance portions including a mesh part, wherein the central conveyance portion has a different shape than the end conveyance portions so that a force to convey the developer from the second room to the first room is stronger by the central conveyance portion than by the each end conveyance portion, wherein superfluous developer accumulated in the first room returns to the second room through at least portions of the opening which are formed above the end portions of the wall.

2. The developer supply device according to claim 1, wherein the roller includes a shaft and a carrying part disposed around the shaft of the roller and configured to carry the developer, wherein, when Dcr is a length of the carrying part of the roller in the first direction, Dwl is a length of the central portion of the wall in the first direction, and Daj is a length of the rotating member of the agitator in the first direction, the developer supply device satisfies a following relationship:

$$Dcr > Dwl \geq Daj.$$

3. The developer supply device according to claim 2, further comprising a developer supplying member disposed between the roller and the wall and configured to supply the developer to the roller, wherein the developer supplying member includes a shaft and a supplying part disposed around the shaft of the developer supplying member and configured to supply the developer, wherein, when Dsp is a length of the supplying part of the developer supplying member in the first direction, the developer supply device satisfies a following relationship:

$$Dcr \geq Dsp > Dwl \geq Daj.$$

4. The developer supply device according to claim 1, wherein the central conveyance portion has a different shape than the end conveyance portions.

5. The developer supply device according to claim 1, wherein a circumferential surface of the roller is disposed near the wall with an interval.

6. The developer supply device according to claim 1, wherein the rotation axis of the roller is disposed above the highest portion of the central portion of the wall when the developer supply device is in use.

7. The developer supply device according to claim 1, further comprising a restricting member fixed to the casing and configured to remove a part of the developer carried by the roller so as to restrict an amount of the developer carried by the roller, wherein the restricting member contacts a circumferential surface of the roller above the first room, downstream side of a movement direction of the circumferential surface of the roller and upstream side of a development position where the developer is supplied by the developer supply device.

8. The developer supply device according to claim 7, wherein the restricting member directs the removed developer to the second room.

9. The developer supply device according to claim 1, further comprising side seal members disposed on both ends of the opening in the width direction to prevent leakage of the developer from the opening.

10. The developer supply device according to claim 1, further comprising a lower seal member disposed on a lower end of the first room when the developer supply device is in use, to prevent leakage of the developer from the lower end of the first room.

11. The developer supply device according to claim 1, wherein the roller is a brush roller including:

a roller body having a circumferential surface; and a brush layer formed on the circumferential surface to carry the developer.

12. The developer supply device according to claim 11, further comprising a restricting member fixed to the casing and configured to remove a part of the developer carried by the roller so as to restrict an amount of the developer carried by the roller, wherein the restricting member includes:

a fixing part fixed to the casing; and a restricting part formed in an edge of the fixing part, the restricting part extending towards a central axis of the roller to contact the brush layer.

13. The developer supply device according to claim 1, wherein the roller comprises a development roller configured to contact a photoconductive drum and supply the developer to the photoconductive roller on which an electrostatic latent image is formed.

14. The developer supply device according to claim 1, further comprising a development roller, wherein the roller comprises a supplying roller configured to contact the development roller and supply the developer to the development roller.

15. The developer supply device according to claim 2, wherein Daj is equal to a length of the rotating member of the agitator between a first end and a second end in the first direction.

16. The developer supply device according to claim 1, wherein the agitator is arranged inside the second room.

17. The developer supply device according to claim 1, wherein the wall is disposed between the roller and the agitator in a direction perpendicular to the first direction.

18. A developer supply device, comprising:

a roller configured to carry developer, extending in a first direction the first direction being in a direction of a rotation axis of the roller and horizontal when the developer supply device is in use;

a casing in which a first room and a second room are defined, the roller being disposed in the first room, the second room being configured to store the developer;

a wall extending over a length of the casing in the first direction, the first room and the second room being partitioned by the wall, an opening being formed above the wall over the length of the wall when the developer supply device is in use; and an agitator configured to convey the developer from the second room to the first room, the agitator including a shaft and a rotating member fixed to the shaft, the shaft being rotatably supported by the casing and configured to rotate in the second room;

wherein the wall is divided into:

end portions which are both end portions, in the first direction, of the wall and having a first height at upper ends of the end portions; and a central portion defined as a portion, between the end portions, having a predetermined length in the first direction and having a second height which is higher than the first height, the central portion having an upper end that is continuous with the upper ends of the end portions, wherein the agitator is configured to convey the developer from the second room to the first room through at least a portion of the opening which is formed above at least the central portion of the wall, wherein the developer conveyed over the wall accumulates in the first room, wherein the roller is configured to collect the developer accumulated in the first room, and wherein the rotating member of the agitator includes a central conveyance portion corresponding to the central portions of the wall and end conveyance portions respectively corresponding to the end portions of the wall, each of the end conveyance portions including a plurality of penetrating holes, wherein the central conveyance portion has a different shape than the end conveyance portions so that a force to convey the developer from the second room to the first room is stronger by the central conveyance portion than by the each end conveyance portion, wherein superfluous developer accumulated in the first room returns to the second room through at least portions of the opening which are formed above the end portions of the wall.

* * * * *